US006012298A

United States Patent [19]

Goldstein

[11] Patent Number: 6,012,298

[45] Date of Patent: Jan. 11, 2000

[54] ICE SLURRY DELIVERY SYSTEM

[75] Inventor: Vladimir Goldstein, King City, Canada

[73] Assignee: Sunwell Engineering Company Limited, Ontario, Canada

[21] Appl. No.: 08/913,528

[22] PCT Filed: Feb. 27, 1996

[86] PCT No.: PCT/CA96/00113

§ 371 Date: Jan. 28, 1998

§ 102(e) Date: Jan. 28, 1998

[87] PCT Pub. No.: WO96/27109

PCT Pub. Date: Sep. 6, 1996

[30] Foreign Application Priority Data

Feb. 27, 1995 [CA] Canada ..... 2143465

[51] Int. Cl.[7] ..... F25D 17/02

[52] U.S. Cl. ..... 62/185; 62/330

[58] Field of Search ..... 62/330, 185

[56] References Cited

U.S. PATENT DOCUMENTS

| | | | |
|---|---|---|---|
| 3,216,215 | 11/1965 | Schuett | 62/185 |
| 4,249,388 | 2/1981 | Burns | 62/185 |
| 4,401,449 | 8/1983 | Martin et al. | 62/330 |
| 4,406,138 | 9/1983 | Nelson | 62/185 |
| 4,509,344 | 4/1985 | Ludwigsen et al. | 62/330 |
| 4,901,539 | 2/1990 | Garber et al. | 62/306 |
| 4,912,935 | 4/1990 | Goldstein | 62/123 |
| 4,936,102 | 6/1990 | Goldsetin et al. | 62/330 |
| 5,381,670 | 1/1995 | Tippmann et al. | 62/330 |

FOREIGN PATENT DOCUMENTS 1033872 of 0000 United Kingdom .

OTHER PUBLICATIONS

PCT International Search Report dated Sep. 19, 1996.
PCT Preliminary Examination Report dated Apr. 4, 1997.

*Primary Examiner*—William E. Tapolcal
*Attorney, Agent, or Firm*—Baker & Daniels

[57] ABSTRACT

A method and system for delivering aqueous ice slurry is disclosed. In one embodiment, the ice slurry delivery system includes a storage tank having an inlet to receive an aqueous ice slurry from an ice generating unit. A circulation loop is connected to the storage tank. Ice slurry held in the storage tank flows through the circulation loop generally continuously at a first rate. Valved discharge points are located along the circulation loop at spaced locations and are operable to re-direct some of the ice slurry flowing though the circulation loop to deliver ice slurry for end use upon demand. The rate of flow of ice slurry through the discharge points is less than the first rate even when all of the discharge points are re-directing ice slurry for end use.

13 Claims, 7 Drawing Sheets

ICE SLURRY DELIVERY SYSTEM

The present invention relates to ice delivery systems and in particular to a method and system for the deliver of an aqueous ice slurry.

Aqueous ice slurry generating units and storage systems for such ice slurry are known in the art. Cooling systems incorporating generating units and storage systems of this nature are of interest due to the high cooling capacity of ice slurry.

An ice storage and distribution unit for ice slurry is disclosed in Applicant's U.S. Pat. No. 4,912,935 issued on Apr. 3, 1990. The ice storage and distribution unit includes a tank which receives ice slurry generated by an ice generating unit. Ice slurry which enters the tank separates into a brine solution and a floating ice bed on top of the brine solution. An agitator is located near the top of the tank and is operable to scrape the ice bed to discharge ice from the storage tank into an outlet, when it is desired to distribute ice. When the agitator is operated, make-up brine and/or fresh water is added to the outlet to place the ice discharged from the tank back into slurry form. The ice slurry is then fed to a positive displacement or centrifugal pump which delivers the ice slurry to the desired end location.

Although this ice storage and distribution unit works satisfactorily, the high inertia of the tank prevents frequent on/off operation of the agitator to deliver ice slurry. Also, when a positive displacement pump is used, the pump must be started and stopped every time ice is discharged from the tank.

In most cooling systems of this nature, the ice slurry must be delivered to multiple discharge points positioned at various location throughout the system. Thus, depending on the number of discharge points which are discharging ice slurry, the discharge rate of the cooling system may vary. The ice storage and distribution unit described in U.S. Pat. No. 4,912,935 is not readily adapted for use in a cooling system of this nature since it is difficult to operate the agitator in the tank to deal with the variable discharge rate of the system as discharge points are turned off and on. Also, when only a few discharge points are operational, the velocity of the ice slurry in the delivery line may drop below the critical velocity resulting in separation of the ice and brine in the ice slurry and therefore, possible plugging of the delivery line.

It is therefore, an object of the present invention to provide a novel method and system for the delivery of ice slurry.

According to one aspect of the present invention there is provided an ice slurry delivery system comprising:

a storage tank to hold an aqueous ice slurry having inlet means to receive fine particles of ice and an aqueous solution;

an ice slurry circulation loop having an inlet and an outlet, both of which are connected to said storage tank, to circulate ice slurry held in said storage tank generally continuously between said inlet and said outlet at a first rate; and discharge means located along said circulation loop intermediate said inlet and outlet to re-direct some of the ice slurry in said circulation loop to an end use at a second rate less than said first rate.

Preferably, the circulation loop includes an ice slurry conduit and a pump along the ice slurry conduit to circulate ice slurry from the storage tank along the ice slurry conduit between the inlet and outlet and the discharge means is in the form of at least one valved discharge conduit connected to the ice slurry conduit. It is also preferred that pump means is located along at least one of the valved discharge conduits to control the delivery of the ice slurry.

A method of delivering ice is also provided.

According to another aspect of the present invention there is provided an ice slurry delivery system comprising:

an ice slurry circulation loop to circulate ice slurry therethrough generally continuously at a first rate;

discharge means located along said circulation loop intermediate said inlet and outlet to re-direct some of the ice slurry in said circulation loop to an end use at a second rate less than said first rate;

an ice generating unit to generate fine particles of ice in an aqueous solution to create an aqueous ice slurry, said ice generating unit having an outlet connected to said circulation loop to deliver ice slurry thereto and having an inlet connected to the circulation loop to receive ice slurry from said circulation loop; and a make-up inlet to deliver aqueous solution to said circulation loop.

According to still yet another aspect of the present invention there is provided a method of cooling food product comprising the steps of:

collecting in a mixing zone, an aqueous ice slurry and food product to be cooled;

conveying said ice slurry together with said food product from said storage zone to a separation zone via conduit means to cool said food product; and separating said food product from said ice slurry in said separation zone.

Embodiments of the present invention will now be described more fully with reference to the accompanying drawings in which.

Figure 1:
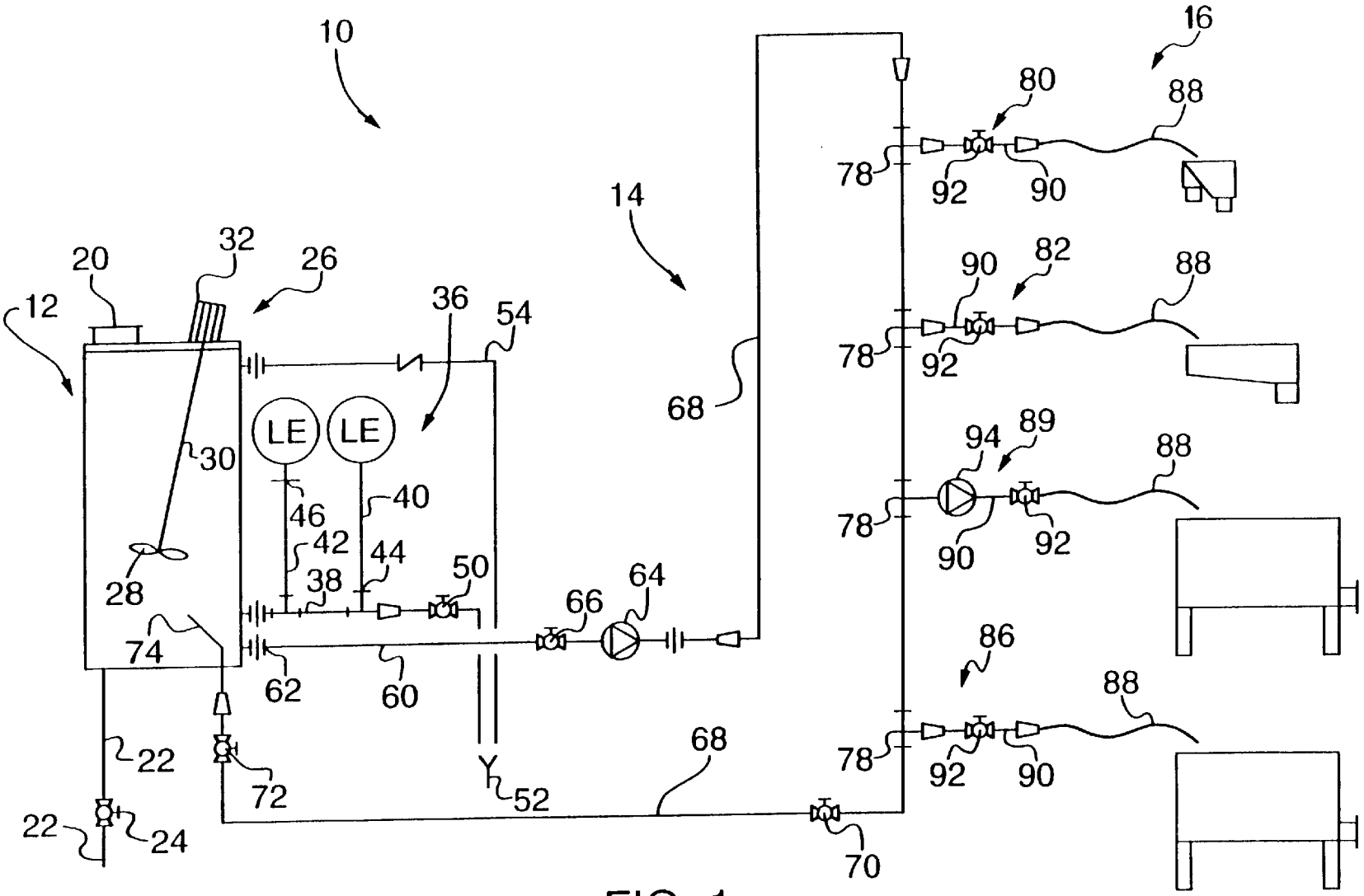
FIG. 1 is a schematic diagram of an aqueous ice slurry delivery system.

Referring to FIG. 1, an aqueous ice slurry delivery system is shown and is generally indicated by reference numeral 10. The delivery system 10 includes a storage tank 12, an ice slurry circulation loop 14 connected to the storage tank 12 and a plurality of valved discharge points 16 extending from the circulation loop. Aqueous ice slurry held in the storage tank 12 flows from the storage tank through the circulation loop 14 and back to the storage tank generally continuously. However, some of the ice slurry flowing through the circulation loop 14 can be re-directed from the circulation loop 14 via one or more of the discharge points 16 for end use.

The storage tank 12 has an inlet 20 at its top to receive fine ice particles produced by an ice-making machine. An aqueous solution make-up inlet 22 is connected to the bottom of the storage tank 12 by way of valve 24 and introduces an aqueous solution such as fresh water or brine into the storage tank 12. An agitator 26 is also provided on the storage tank 12 to mix the fine ice particles and aqueous solution thoroughly within the storage tank. The agitator 26 includes a mixing blade 28 mounted on one end of a drive shaft 30 extending into the storage tank. A motor 32 located on the top of the storage tank 12 rotates the drive shaft 30.

A level sensing arrangement 36 is also associated with the storage tank 12 to detect low and high ice slurry levels within the storage tank. The level sensing arrangement includes a generally horizontal conduit 38 extending from the side of the storage tank. Two generally vertical conduits 40 and 42 extend from the horizontal conduit and fill with aqueous solution as the ice slurry level in the storage tank 12 increases. Conduit 40 has a sensor 44 in it which detects a desired low ice slurry level in the storage tank 12. Conduit 42 has a sensor 46 in it which detects a desired high ice slurry level in the storage tank. The output of the sensors 44 and 46 is used to control the introduction of fine ice particles into the storage tank 12 via the inlet 20 and as well as the introduction of aqueous solution into the storage tank 12 via make-up inlet 22.

The horizontal conduit 38 is also connected to a valve 50 which leads to a drain 52. An overflow conduit 54 extending from the top of the storage tank 12 also leads to the drain 52.

The circulation loop 14 includes a delivery line 60 coupled to the storage tank 12 via inlet connection 62 located near the bottom of the storage tank 12 below conduit 38. Delivery line 60 is connected to a pump 64 by way of valve 66. Conduit 68 is connected to the discharge port of the pump 64 and leads back to the storage tank 12. A pair of valves 70 and 72 are positioned along the conduit 68. The outlet end of conduit 68 terminates within the storage tank 12 and is configured to form a nozzle 74 so that ice slurry discharged by the nozzle 74 assists in the agitation of the ice slurry in the storage tank.

The valved discharge points 16 are connected to conduit 68 at spaced locations between pump 64 and valve 70 via T-connections 78. In this particular embodiment, four discharge points 80 to 86 are shown. Discharge points 80, 82 and 86 are virtually identical and each includes a flexible discharge hose 88 connected to conduit 68 by way of a discharge line 90, a valve 92 and T-connection 78. Discharge point 84 also includes a flexible discharge hose 88 connected to conduit 68 by way of a valve 92, a discharge line 90 and T-connection 78. However, discharge point 84 also includes a positive displacement pump 94 along discharge line 90 to control ice slurry throughput.

The operation of the ice slurry delivery system 10 will now be described. When the storage tank 12 is holding ice slurry and the ice slurry level within the storage tank is above the level of the sensor 46 in conduit 42, valve 24 is closed to prevent additional aqueous solution from entering the storage tank 12 via make-up inlet 22 and no fine ice particles are introduced into the storage tank 12 via inlet 20. The motor 32 is powered to rotate the shaft 30 and hence, the mixing blade 28 to mix thoroughly the ice slurry within the storage tank to prevent the ice slurry from separating into its constituents. While this occurring, pump 64 draws ice slurry from the storage tank 12 via inlet connection 62, delivery line 60 and valve 66 and pumps the ice slurry through the conduit 68. The ice slurry pumped into conduit 68 flows back to the storage tank (assuming valves 70 and 72 are open) and is discharged into the storage tank 12 via nozzle 74 to assist in the ice slurry agitation.

When an end user requires ice slurry, one or more of the valves 92 can be opened to allow some of the ice slurry flowing through conduit 68 to flow into the flexible hose 88 via discharge line 90. Ice slurry that does not flow through a discharge line 90 is returned back to the storage tank 12 in the manner described above.

The pump 64 is designed to ensure that the flow of ice slurry through the circulation loop 14 is substantially higher than the flow of ice slurry through the discharge points 16 even when the valves 92 of all of the discharge points are open. This ensures that some ice slurry is always circulating through the entire circulation loop 14.

As ice slurry is drawn from the conduit 68 by one or more discharge points 80 to 86, the ice slurry level in the storage tank 12 drops. When the ice slurry level in the storage tank 12 drops to a level where the aqueous solution level in conduit 40 falls below the sensor 44, the sensor 44 provides an output signal. The output of sensor 44 is used to initiate the supply of aqueous solution into the storage tank 12 by way of make-up inlet 22 and valve 24 as well as to initiate the supply of fine ice particles into the storage tank 12 by way of inlet 20. If the supply rate of the aqueous solution and ice particles into the storage tank 12 is higher than the rate that ice slurry is being drawn from conduit 68 by one or more of the discharge points, then the ice slurry level within the storage tank 12 will rise. As the level of ice slurry within the storage tank rises, the aqueous solution level in conduits 40 and 42 also rises. When the level of ice slurry in the storage tank 12 reaches a level where the aqueous solution level in conduit 42 reaches the sensor 46, the sensor 46 provides an output signal which is used to stop the introduction of aqueous solution into the storage tank 12 via make-up inlet 22 as well as the introduction of ice particles into the storage tank via inlet 20.

Although ice slurry delivery system 10 has been described as including both agitator 26 and nozzle 74 to agitate ice slurry held in the storage tank 12, it should be appreciated that only one of these two components needs to be used to agitate the ice slurry.

Figure 2:
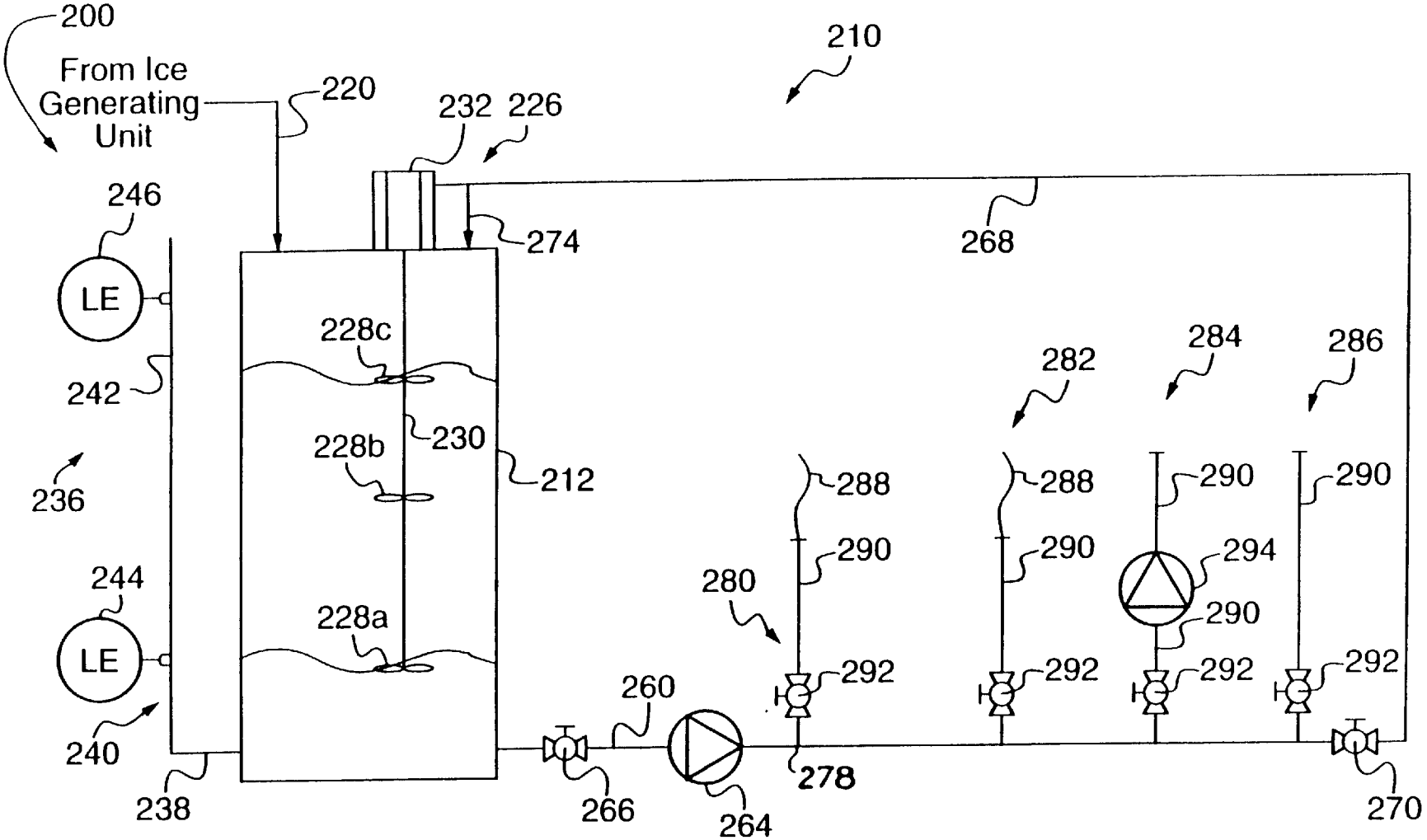
FIG. 2 is a schematic diagram of another embodiment of an aqueous ice slurry delivery system.

Referring now to FIG. 2, another embodiment of an ice slurry delivery system 210 is shown. For the sake of clarity, like reference numerals will be used to indicate like components with a "200" added for clarity. In this embodiment of the ice slurry delivery system 210, the storage tank 212 has a single inlet 220 which receives ice slurry from an ice generating unit (not shown) such as that disclosed in Applicant's U.S. Pat. No. 4,976,441 issued on Jan. 10, 1989. The storage tank 212 is larger in dimension then storage tank 12 shown in the previous embodiment. In order to ensure sufficient agitation for ice slurry held within the storage tank 212, the shaft 230 of the agitator 226 has three spaced mixing blades 228*a*, 228*b* and 228*c* on it. The level sensing arrangement 236 includes a single conduit 240 which has a horizontal section 238 and a vertical run 242 generally parallel to the storage tank 212. Sensors 244 and 246 are located within the vertical run 242 to detect low and high ice slurry levels within the storage tank 212.

The circulation loop 214 in this embodiment is very similar to that in the previous embodiment except that only one valve 270 is located along the conduit 268 between pump 264 and storage tank 212. In addition, conduit 268 terminates at a nozzle 274 located near the top of the storage tank 212.

With respect to the discharge point 280 to 286, in this embodiment, only two of the discharge points 280 and 282 include flexible discharge hoses 288.

The operation of the ice slurry delivery system 210 is very similar to that of ice slurry delivery system 10. In particular, when the storage tank 212 is holding ice slurry and the ice slurry level within the storage tank is above the level of sensor 246 in vertical run 242, the ice generating unit (not shown) is turned off so that no ice slurry is supplied to the storage tank 212 via inlet 220. The motor 232 is powered to rotate the shaft 230 and hence the mixing blades 228*a* to 228*c* to mix thoroughly the ice slurry within the storage tank 212. While this occurs, pump 264 draws ice slurry from the storage tank 212 via delivery line 260 and valve 266. The ice slurry is then pumped into conduit 268 where it circulates through circulation loop 214 before being discharged into the storage tank 212 via nozzle 274.

When an end user requires ice slurry, one or more of the valves 292 can be opened to allow some of the ice slurry flowing through conduit 268 to flow into the discharge lines 290. Ice slurry that does not flow through a discharge line 290 is returned back to the storage tank 212. Pump 264 is designed to ensure that the flow of ice slurry through the circulation loop 214 is substantially higher than the flow of ice slurry through the discharge points 280 to 286 even when the valves 292 of all of the discharged points 280 to 286 are open. If ice slurry is drawn from conduit 268 via one or more of the discharge points and the level of ice slurry in the storage tank 212 falls below the level of the sensor 244, the output of the sensor 244 is used to start the ice generating unit so that ice slurry is introduced into the storage tank 212 by way of inlet 220 as well as to stop agitator 226 and pump 264. The ice generating unit is operated until the ice slurry level in the storage tank 212 reaches the level of sensor 246 at which time, the output the sensor 246 is used to stop the operation of the ice generating unit and to restart agitator 226 and pump 264.

Figure 3:
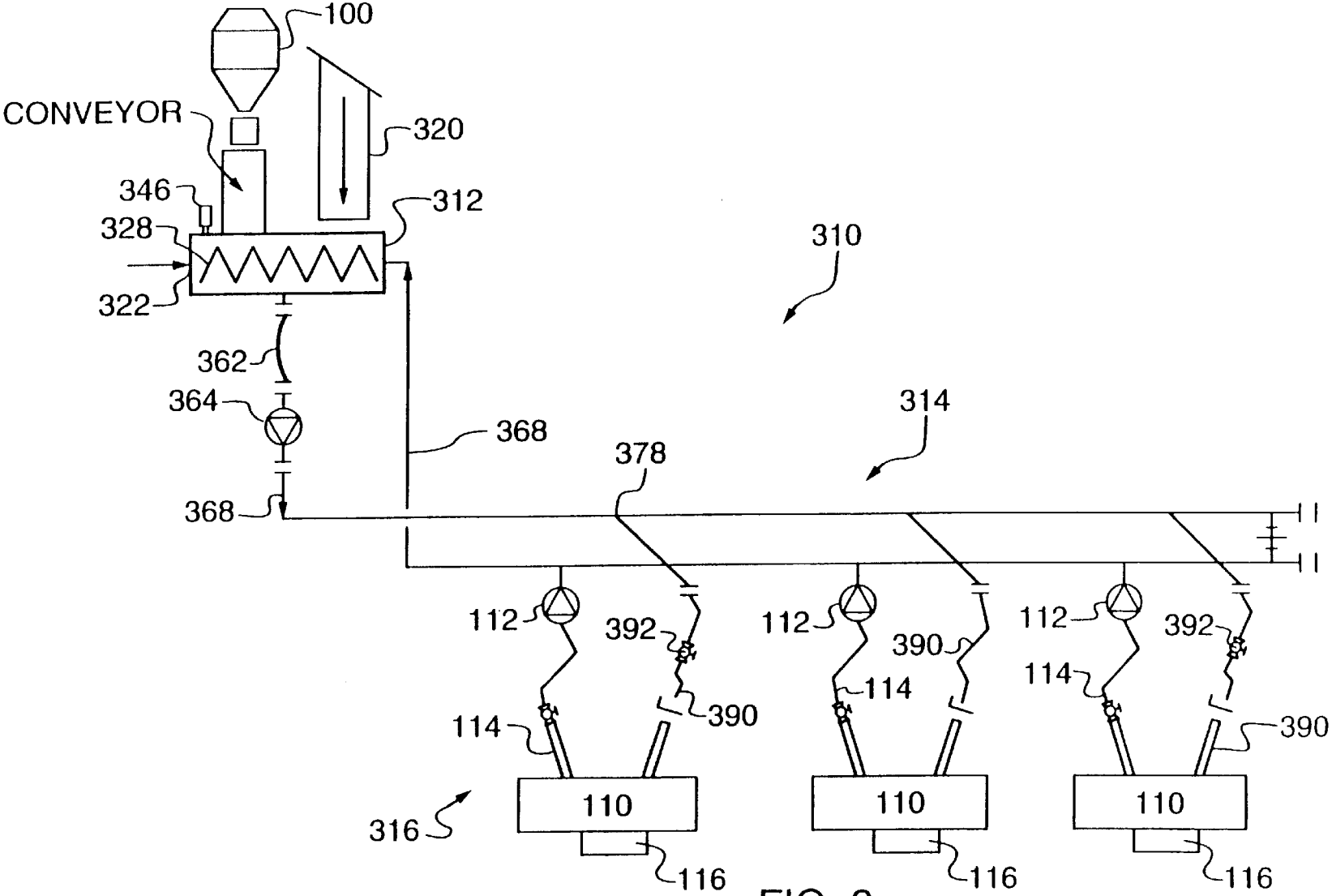
FIG. 3 is a schematic diagram of another embodiment of an aqueous ice slurry delivery system.

Referring to FIG. 3, yet another embodiment of an ice slurry delivery system is shown. In this embodiment, like reference numerals will be used to indicate like components with a "300" added for clarity. The storage tank 312 includes an inlet chute 320 to allow fine ice particles to be delivered into the storage tank. The storage tank 312 also communicates with a conveyor installation 100 to allow rock salt or other materials to be introduced into the storage tank 312. Similar to FIG. 1, a make-up inlet 322 communicates with the storage tank 312 to introduce aqueous solution such as brine or fresh water into the storage tank.

The agitator 326 in this embodiment includes an auger type mixing blade 328 to mix the contents of the storage tank 312 thoroughly. The level sensing arrangement 336 includes a single sensor 346 mounted on the storage tank 312. Introduction of aqueous solution via make up inlet 322, fine ice particles via inlet 320 and rock salt of other material by the conveyor installation 100 into the storage tank 312 continues until the ice slurry level within the storage tank 312 reaches the level of sensor 346. Whenever the ice slurry level in the storage tank 312 drops below the level of sensor 346, aqueous solution, fine ice particles and other material are introduced into storage tank 312 to maintain the ice slurry level within the storage tank at a desired level.

With respect to the discharge points 380 to 384, in this embodiment, the discharge points include discharge lines 390 which lead to ice and brine separators 110. The discharge lines 390 may or may not include valves 392. The separators 110 separate ice from brine to store dry ice and to collect brine. The brine collectors in the separators 110 are connected to the conduit 368 downstream of all of the discharge lines 390 by way of pumps 112 and recycle lines 114 so that collected brine in the separators 110 can be recirculated back to the storage tank 312. Dry ice stored in the separators 110 can be discharged by way of outlet ports 116.

The operation of ice slurry delivery system 310 is basically the same as the ice slurry delivery systems shown in the previous embodiments. Accordingly, ice slurry held in the storage tank 312 is circulated through the circulation loop 314 and returned back to the storage tank 312 at a rate which is higher than the rate at which ice slurry is drawn from conduit 368 by the discharge points 380, 382 and 384. However, unlike the previous embodiments, ice slurry drawn from conduit 368 by the discharge points is delivered to ice and brine separators 110 by discharge lines 390. The ice brine separators 110 separate ice from brine and allow brine collected in the separators to be returned to conduit 368 by way of recycle lines 114 and pumps 112. Dry ice stored in the separators 110 can be delivered for end use by outlet ports 116.

Figure 4:
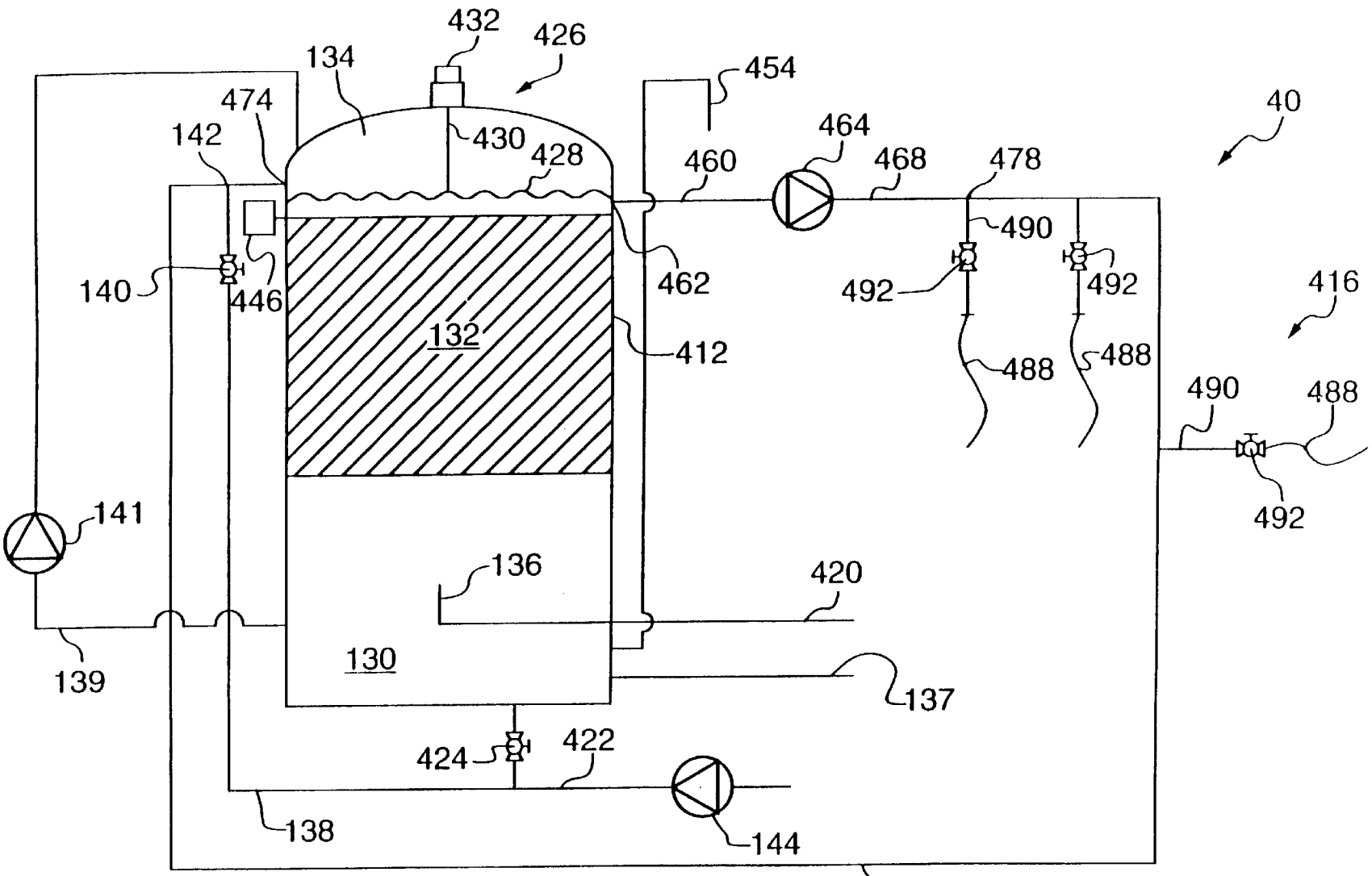
FIG. 4 is a schematic diagram of another embodiment of an aqueous ice slurry delivery system.

Referring now to FIG. 4, yet another embodiment of an ice slurry delivery system 410 is shown. In this embodiment, like reference numerals will be used to indicate like components with a "400" added for clarity. In this embodiment, storage tank 412 is similar to those described in Applicant's U.S. Pat. No. 4,912,935. Thus, the storage tank 412 is divided into three separate zones, namely a brine zone 130 near the bottom of the storage tank, an ice bed zone 132 above the brine zone and an ice slurry mixing zone 134 above the ice bed zone. The storage tank 412 has an agitator 426 which includes a scraper blade 428 movable over the top of an ice bed within the storage tank 412 to remove ice from the ice bed. Inlet 420 is positioned in the brine zone 130 and includes an upright nozzle 136 within the storage tank 412 to deliver ice slurry received from an ice generating unit (not shown). A brine return line 137 is connected to the storage tank 412 in the brine zone 130 to supply brine to the ice generating unit. An overflow conduit 454 extends from the storage tank 412 and leads to a drain in the event that the storage tank is overfilled. A transfer line 139 having a pump 141 along its length is connected to the storage tank 412 at the brine zone 130 and the ice slurry mixing zone 134. The pump 141 and transfer line 139 transfer brine solution from the brine zone 130 to the ice slurry mixing zone 134 to inhibit the ice bed in zone 132 from rising and increasing the ice fraction in the ice slurry created in zone 134.

In this embodiment, the inlet connection 462 of the circulation loop 414 is located adjacent the ice slurry mixing zone 134. The outlet nozzle 474 of conduit 468 is connected to the storage tank 412 in the ice slurry mixing zone above the agitator blade 428. The make-up inlet 422 in this embodiment is not only connected to the bottom of the storage tank 412 by way of valve 424 but it is also connected to a conduit 138. Conduit 138 is connected to conduit 468 near the nozzle 474 by way of valve 140 and T-connection 142. A pump 144 is located along make-up inlet 422 to assist in the delivery of aqueous solution to the storage tank 412.

The operation of ice slurry delivery system 410 is very similar to those embodiments previously described. Ice slurry enters the brine zone 130 of storage tank 412 from the ice generating unit via inlet 420 and nozzle 136. When ice slurry enters the brine zone 130, the ice slurry separates into a body of brine and an ice bed floating on top of the brine. In order to produce ice slurry, the agitator 426 is operated to scrape the top of the ice bed using blade 428. Initially, aqueous solution is introduced into the top of the storage tank 412 by way of make-up inlet 422, pump 144, conduit 138, valve 140 and nozzle 474 as well as by transfer line 139 and pump 141. The aqueous solution and scraped ice are mixed by the agitator and are delivered to delivery line 460 by way of inlet connection 462. The pump 464 in turn circulates the ice slurry through conduit 468 where it is returned to the storage tank 412 via nozzle 474. Once a steady flow of ice slurry is delivered back into the storage tank 412 by way of conduit 468, the valve 140 can be closed to stop the introduction of aqueous solution into the top of the storage tank from the make-up inlet 422.

Similar to the previous embodiments, the agitator 426 and pump 464 are operated to ensure that the flow of ice slurry through conduit 468 is at a rate greater than the flow of ice slurry through the discharge points 480 to 484. The level sensor 446 monitors the level of the ice bed in the storage tank 412 and when the ice bed drops below a desired level, valve 424 is opened to introduce aqueous solution into the storage tank 412 to raise the level of the ice bed back to the desired level. Valve 140 is also opened to introduce aqueous solution into the ice slurry mixing zone 134 to maintain ice slurry created in the zone at desired consistency. The ice generating unit is operated periodically to introduce ice slurry into the storage tank 412 to maintain an ice bed in zone 132.

If storage tank 412 is flooded by maintaining valves 424 and 140 opened, level sensor 446 can be omitted. The ice fraction in ice slurry created in zone 134 can be adjusted by controlling valve 424 and 140 and by operating pump 141 along transfer line 139.

Figure 5:
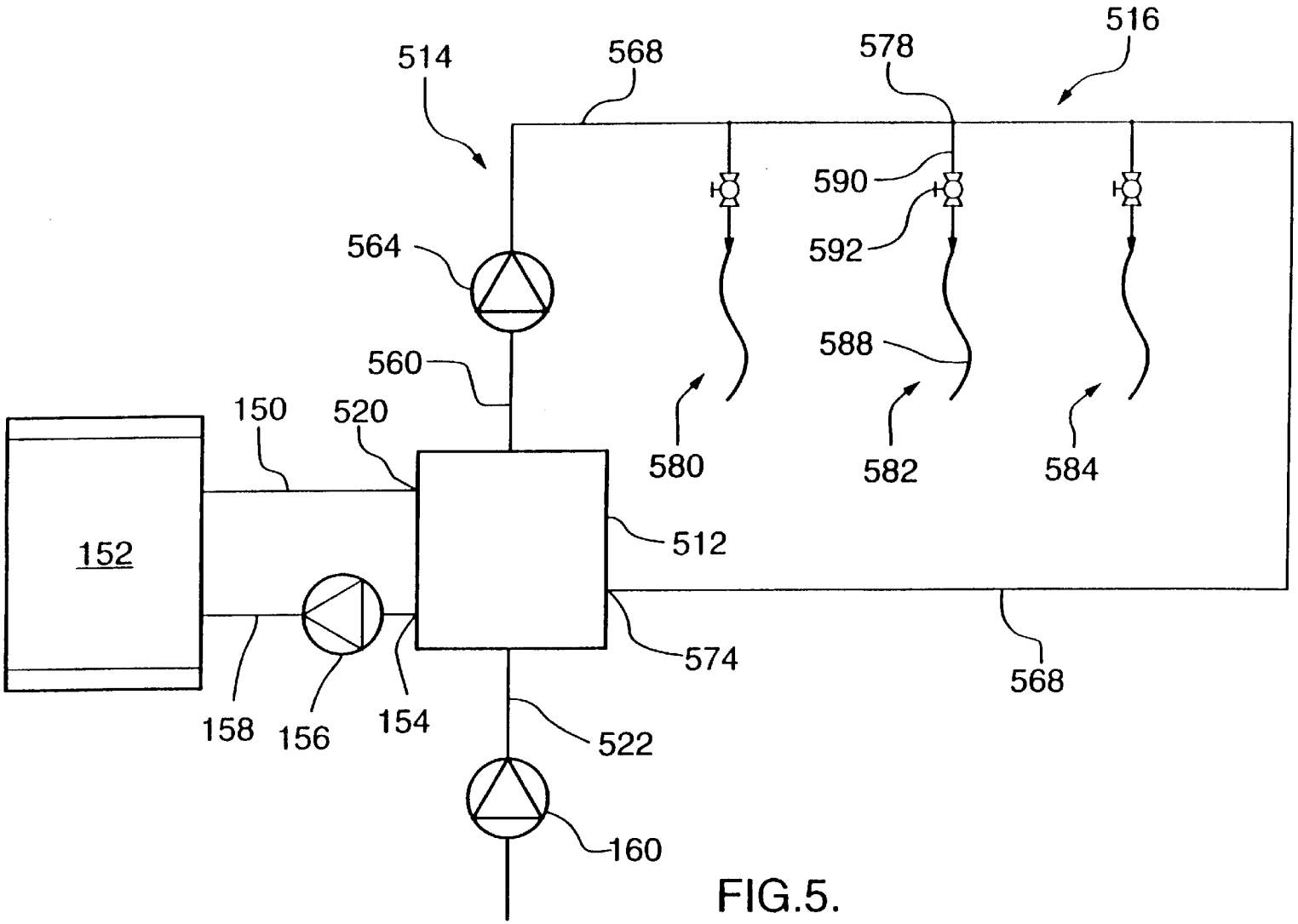
FIG. 5 is a schematic diagram of another embodiment of an aqueous ice slurry delivery system.

Referring now to FIG. 5, yet another embodiment of an ice slurry delivery system 510 is shown. In this embodiment, like reference numerals will be used to indicate like components with a "500" added for clarity. In this embodiment, the storage tank 512 is in the form of a centrifugal cyclone separator having a tangential ice slurry inlet 520 connected to a supply line 150 leading from an ice generator 152. Conduit 568 of circulation loop 514 terminates at the storage tank 512 via nozzle 574. Similar to inlet 520, nozzle 474 is in the form of a tangential inlet. The storage tank 512 has an outlet to which delivery line 560 is connected. A second outlet 154 also extends from the storage tank 512 and leads to a pump 156 which in turn is connected to the ice generating unit 152 by way of return line 158. Similar to the previous embodiments, make-up inlet 522 leads to the storage tank 512 to deliver aqueous solution thereto. Delivery of the aqueous solution to the storage tank via the make-up inlet is assisted by pump 160.

In operation of the ice slurry delivery system 510, ice slurry is delivered to the storage tank 512 by the ice generating unit 152. The ice slurry delivered to the storage tank 512 is fed to the circulation loop 514 where it flows through the circulation loop and is delivered back to the storage tank 512. Ice slurry can be drawn from the conduit 568 by one or more of the discharge points 580 to 584 in the manner previously described.

The configuration of the storage tank 512 allows the ice slurry delivered to the circulation loop 514 to be of a much greater ice fraction than the ice slurry produced by the ice generating unit 152. This allows the ice generating unit to be operated in a manner which reduces energy requirements while still allowing the system 510 to deliver ice slurry having a high ice fraction for end use. The operation of the storage tank 512 to achieve this will now be described.

As mentioned previously, the inlet 520 and nozzle 574 are configured as tangential inlets. When ice slurry is delivered to the inlet 520 and nozzle 574, the velocity of the two streams of ice slurry creates a cyclone effect inside the storage tank 512. Since the fine ice particles in the ice slurry are lighter than the aqueous solution, the fine ice particles conglomerate near the centre of the storage tank 512 and are drawn from the storage tank via delivery line 560 and pump 564. The aqueous solution concentrates near the outside walls of the storage tank and is fed back to the ice generating unit 152 via outlet 154, pump 156 and return line 158.

Figure 6:
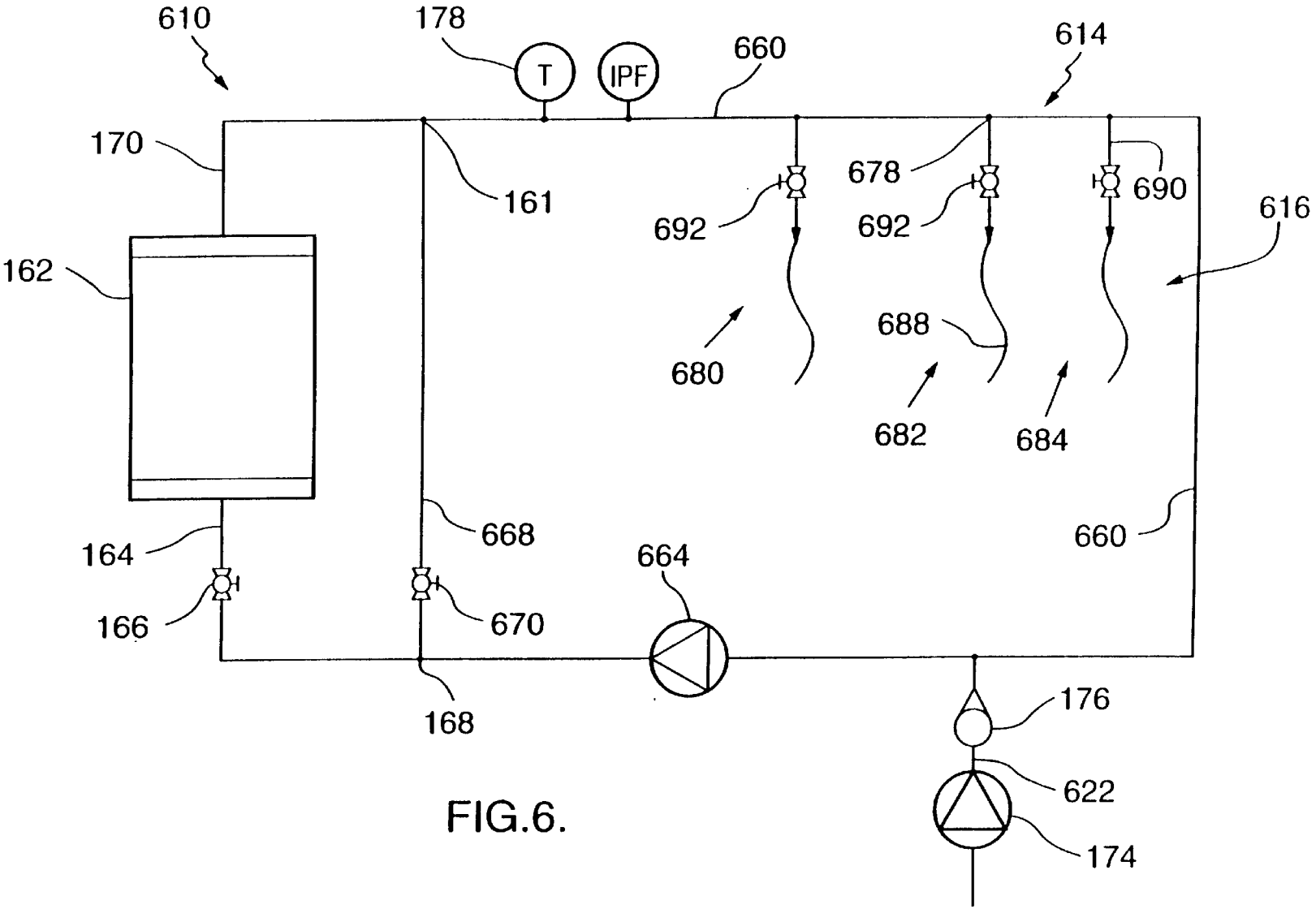
FIG. 6 is a schematic diagram of another embodiment of an aqueous ice slurry delivery system.

FIG. 6 shows yet another embodiment of an ice slurry delivery system 610. In this embodiment, like reference numerals will be used to indicate like components with a "600" added for clarity. In this embodiment, the storage tank is omitted and the conduit 668 is connected to the delivery line 660 by way of T-connection 161. Conduit 668 is also connected to the inlet of an ice generating unit 162 by way of return line 164, valve 166 and T-connection 168. A supply line 170 extends from ice generating unit 162 and leads to the T-connection 161 to supply ice slurry to the delivery line 660.

In this embodiment, the discharge points 680, 682 and 684 are connected to the delivery line 660 instead of the conduit 668. Make-up inlet 622 is also connected to the delivery line 660 to introduce aqueous solution into the circulation loop 614. A pump 174 and a flowmeter 176 are located along the make-up inlet 622 to assist in the delivery of aqueous solution to the circulation loop 614. Ice slurry detection means 178 in the form of a temperature sensor is located along the delivery line 660.

In operation, the ice generating unit 162 is operated to deliver ice slurry to the circulation loop 614. Ice slurry delivered into the circulation loop is delivered to conduit 668 by way of pump 664. Ice slurry delivered to the conduit 668 is fed back to the ice generating unit 162 as well as back to the delivery line 660 by way of T-connection 161 and valve 670. The valves 670 and 166 are adjusted to limit the flow of ice slurry to the ice generating unit 162 to the desired level.

When ice slurry is flowing through the circulation loop 614, it can be drawn from delivery line 660 at any or all of the discharge points 680, 682, 684 in the manner described previously.

When ice slurry is drawn from the delivery line 660, the pump 174 and flowmeter 176 are operated to introduce aqueous solution to the delivery line 660 via make-up inlet 622. As ice slurry is drawn from the circulation loop 614 and replaced with aqueous solution, the ice fraction of the ice slurry in the circulation loop decreases. When this occurs, the torque on the agitators within the ice generating unit 162 also decreases signaling the ice generating unit to increase its capacity so that ice slurry is delivered to the circulation loop to increase the ice fraction of the ice slurry. When no ice slurry is being drawn from the delivery line 660 via the discharge points, the introduction of aqueous solution into the delivery line 660 via the make-up inlet 622 is stopped. This is detected by the flowmeter 176 which in turn provides a signal to shut off the ice generating unit 162. Also, when no ice slurry is being drawn from the delivery line 660 via one or more of the discharge points 680 to 684, the ice fraction and concentration of solution of the ice slurry in the delivery line 660 will increase. This results in a drop in the temperature of the ice slurry in delivery line 660 which is detected by temperature sensor 178. The temperature sensor 178 provides output to the ice generating unit 162 causing it to stop when the temperature of ice slurry in the delivery line 660 reaches a preset temperature.

The present ice slurry delivery system provide advantages in that ice slurry can be delivered to multiple locations along the circulation loop without effecting the flow rate of ice slurry and without placing excessive burden on the ice generating equipment. This is achieved by providing a storage tank bets the ice generating equipment and the discharge points which acts as a buffer and recirculating ice slurry in the tank through a circulation loop at a rate which is always greater than the rate at which ice slurry is drawn from the circulation loop.

Figure 7:
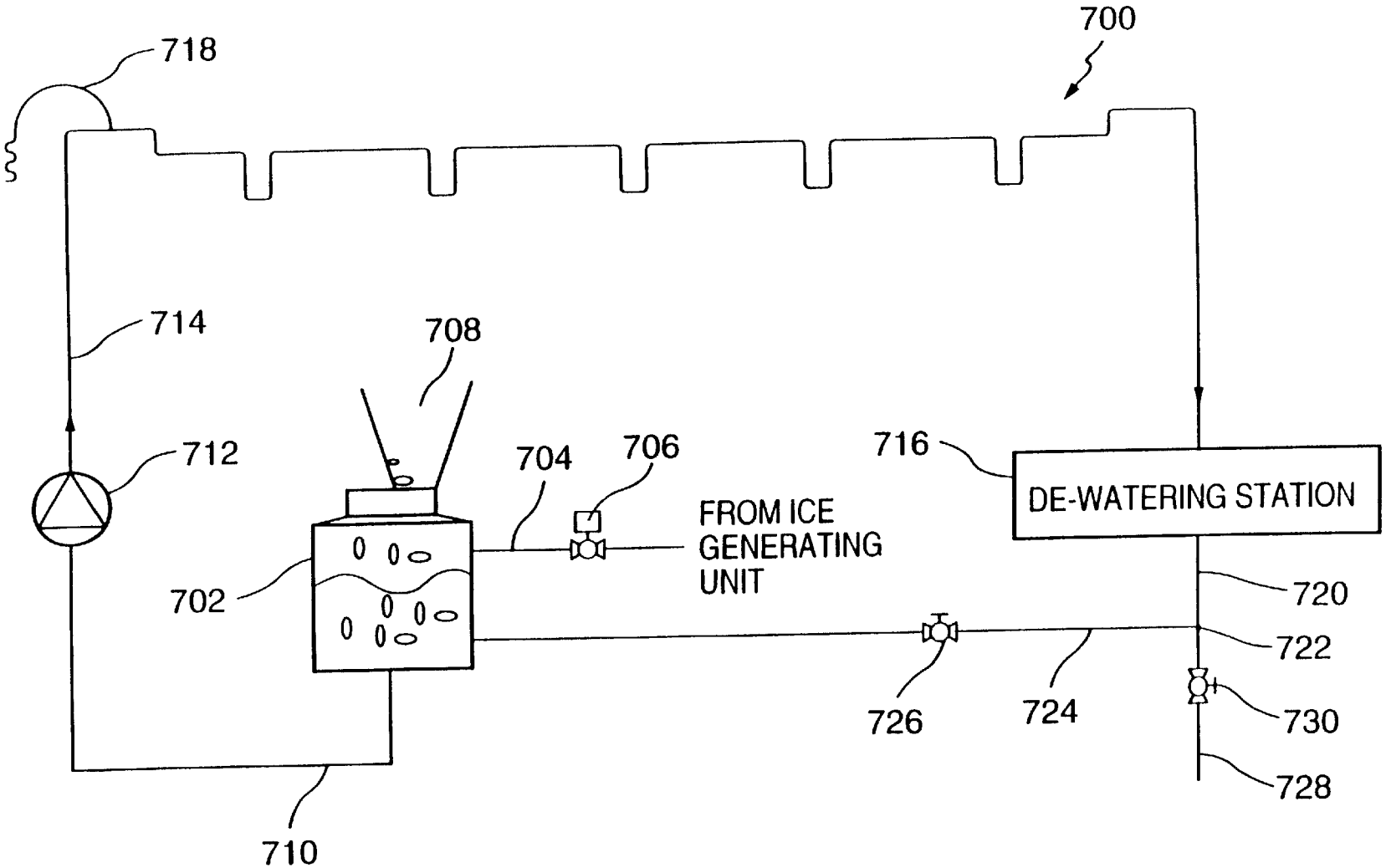
FIG. 7 is a schematic diagram of a food product cooling system.

FIG. 7 shows a system for cooling food products such as vegetables and meat such as for example poultry and fish. As can be seen, cooling systems 700 includes a mixing tank 702 to which is connected an ice slurry inlet line 704. A valve 706 is located along the line 704 to control the flow of ice slurry into the mixing tank 702. The top of the tank is open and communicates with a chute 708. The chute delivers food product to be cooled into the tank 702. A delivery line 710 extends from the bottom of the tank 702 and leads to a pump 712. A supply line 714 extends from the discharge port of the pump 712 and leads to a dewatering station 716. A bleed line 718 is located along the supply line 714. An outlet conduit 720 extends from the dewatering station 716 and leads to a T-connection 722. One of the outlets of the T-connection 722 has a return line 724 connected to it. Return line 724 is connected to tank 702 by way of valve 726. The other outlet of the T-connection leads to a discharge conduit 728 by way of valve 730.

The operation of the cooling system 700 will now be described. Initially, the mixing tank 702 is filled with ice slurry from the ice generating unit via lines 704 and valve 706. Once a sufficient amount of ice slurry is held in the mixing tank, food product such as vegetables, poultry or fish is delivered into the mixing tank by way of chute 708. An agitator (not shown) may optionally be located within the tank to mix the food product and ice slurry. The ice slurry and food product mixture exits the mixing tank 702 via delivery line 710 and is pumped into supply line 714 by pump 712. The supply line 714 is designed to be of a suitable length to ensure good mixing of the food product and the ice slurry and so that the food product in the ice slurry becomes fully chilled before arriving at the dewatering station 716. The ice slurry and fully chilled food product mixture is delivered to the dewatering station 716 wherein the food product and ice slurry are separated. At this point, the chilled food product is in a form fit for packaging. The ice slurry separated from the chilled food product can be returned to the mixing tank 702 by way of lines 720 and 724 and valve 726 or can be discharged from the cooling system 710 by way of lines 720 and 728 and valve 730.

The cooling system 700 is particularly advantageous in facilities where food product is to be prepared in one location in the facility and chilled and packaged in another location in the facility. Most common facilities of this nature prepare the food product at one location and deliver the food product to a chiller at a separate location. The food product must then sit in storage until it reaches the desired temperature. At that time, the food product can be removed from storage and packaged. As one should appreciate, the cooling system 700 allows the food product to be chilled as it is being delivered to the packaging location. It has been found that the cooling system 700 is able to chill food product entering the tank 702 at a temperature between about 80° F. and 90° F. to a temperature of between about 30° F. to 40° F. by the time the food product leaves the tank 702 and reaches the dewatering station 716.

We claim:

1. An ice slurry delivery system comprising:

an ice slurry circulation loop to circulate ice slurry therethrough generally at a first rate;

discharge means located along said circulation loop intermediate said inlet and outlet actuable to re-direct some of the ice slurry in said circulation loop to an end use at a second rate less than said first rate;

an ice generating unit to generate fine particles of ice in an aqueous solution to create an aqueous ice slurry, said ice generating unit having an outlet connected to said circulation loop to deliver ice slurry thereto and having an inlet connected to the circulation loop to receive ice slurry from said circulation loop;

a make-up inlet to deliver aqueous solution to said circulation loop when said discharge means is actuated to deliver ice slurry to said end use; and a flowmeter associated with said make-up inlet to detect delivery of aqueous solution to said circulation loop, said ice generating unit shutting off in response to a signal generated by said flowmeter when delivery of aqueous solution into said circulation loop via said make-up inlet is stopped.

2. A delivery system as defined in claim 1 wherein said circulation loop includes an ice slurry conduit and a pump along said ice slurry conduit to circulate ice slurry from said ice generating unit along said ice slurry conduit between the inlet and outlet and wherein said discharge means is in the form of at least one valved discharge conduit connected to said ice slurry conduit.

3. A delivery system as defined in claim 2 wherein said discharge means is in the form of a plurality of valved discharge conduits connected to said ice slurry conduit at spaced locations, and wherein pump means is located along at least one of said valved discharge conduits to control the delivery of said ice slurry.

4. A delivery system as defined in claim 1 further including valve means located along said circulation loop and adjacent the inlet of said ice generating unit, said valve means being adjustable to control the rate of flow of ice slurry to said ice generating unit and along said circulation loop.

5. A delivery system as defined in claim 1 further including a temperature sensor associated with said circulation loop to detect the temperature of ice slurry in the circulation loop and to provide output to the ice generating unit to shut the ice generating unit off when the temperature of ice slurry in said circulation loop drops to a predetermined temperature.

6. An ice slurry delivery system comprising:

an ice slurry circulation loop, having an inlet and an outlet, to circulate ice slurry therethrough generally at a first rate;

at least one discharge conduit located along said circulation loop intermediate said inlet and outlet, said at least one discharge conduit being actuable to re-direct some of the ice slurry in said circulation loop to an end use at a second rate less than said first rate;

an ice generating unit to generate fine particles of ice in an aqueous solution to create an aqueous ice slurry, said ice generating unit having an outlet connected to said circulation loop to deliver ice slurry thereto and having an inlet connected to the circulation loop to receive ice slurry from said circulation loop, said ice generating unit communicating with at least one detector monitoring a condition of said ice slurry delivery system and operating in response thereto to control the ice fraction of the ice slurry in said circulation loop; and a make-up inlet to deliver aqueous solution to said circulation loop when said at least one discharge conduit is actuated to deliver ice slurry to said end use.

7. A delivery system as defined in claim 6 further including a valve located along said circulation loop adjacent the inlet of said ice generating unit, said valve being adjustable to control the rate of flow of ice slurry along said circulation loop.

8. A delivery system as defined in claim 7 further including a flowmeter associated with said make-up inlet to detect delivery of aqueous solution to said circulation loop.

9. A delivery system as defined in claim 8 wherein said ice generating unit shuts off in response to a signal generated by the flowmeter when delivery of aqueous solution into the circulation loop via the make-up inlet is stopped thereby to control the ice fraction of said ice slurry.

10. A delivery system as defined in claim 9 further including a temperature sensor associated with said circulation loop to detect the temperature of ice slurry in the circulation loop and to provide output to the ice generating unit to shut the ice generating unit off when the temperature of ice slurry in said circulation loop drops to a predetermined temperature thereby to control the ice fraction of said ice slurry.

11. A delivery system as defined in claim 6 wherein said circulation loop includes an ice slurry conduit and a pump along said ice slurry conduit to circulate ice slurry from said ice generating unit along said ice slurry conduit between the inlet and outlet and wherein said at least one discharge circuit includes at least one valved discharge conduit connected to said ice slurry conduit.

12. A delivery system as defined in claim 6 wherein said at least one discharge conduit includes a plurality of valved discharge conduits connected to said ice slurry conduit at spaced locations, and wherein a pump is located along at least one of said valved discharge conduits to control the delivery of said ice slurry to said end use.

13. A delivery system as defined in claim 6 further including a temperature sensor associated with said circulation loop to detect the temperature of ice slurry in the circulation loop and to provide output to the ice generating unit to shut the ice generating unit off when the temperature of ice slurry in said circulation loop drops to a predetermined temperature thereby to control the ice fraction of said ice slurry.

* * * * *